US007883042B2

(12) United States Patent
Torres et al.

(10) Patent No.: US 7,883,042 B2
(45) Date of Patent: Feb. 8, 2011

(54) ATTENUATION OF PRESSURE VARIATIONS IN CRUSHERS

(75) Inventors: Mauricio Torres, Malmö (SE); Kristian Burhoff, Staffanstorp (SE); Johan Edström, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 29 days.

(21) Appl. No.: 12/385,255

(22) Filed: Apr. 2, 2009

(65) Prior Publication Data

US 2009/0256015 A1 Oct. 15, 2009

(30) Foreign Application Priority Data

Apr. 4, 2008 (SE) ..... 0800760

(51) Int. Cl.
*B02C 2/00* (2006.01)

(52) U.S. Cl. ..... 241/207

(58) Field of Classification Search ..... 241/207–216
See application file for complete search history.

(56) References Cited

U.S. PATENT DOCUMENTS 2,579,516 A 12/1951 Roubal
4,060,205 A 11/1977 Pollak
4,187,991 A 2/1980 Petrini Poli
4,192,472 A 3/1980 Johnson
6,446,892 B1 * 9/2002 Fasoli et al. ..... 241/207
2009/0152385 A1 * 6/2009 Vendelin ..... 241/207

FOREIGN PATENT DOCUMENTS

GB 1 517 963 7/1978
GB 2 116 072 9/1983
GB 2 188 253 9/1987

* cited by examiner

*Primary Examiner*—Faye Francis
(74) *Attorney, Agent, or Firm*—Drinker Biddle & Reath LLP

(57) ABSTRACT

A crusher system, including a first crushing surface and a second crushing surface which are operative to crush material between them. A hydraulic system is operative to adjust a gap between the first crushing surface and the second crushing surface by adjusting a position of the first crushing surface with a hydraulic cylinder connected to the first crushing surface. The hydraulic system includes an accumulator connected to the hydraulic cylinder by a hydraulic liquid conduit. The accumulator includes a hydraulic liquid chamber and a gas chamber separated from the hydraulic liquid chamber. The accumulator has a preloading pressure that is the pressure of the gas chamber when the hydraulic liquid chamber is empty, which is at least 0.3 MPa lower than a mean operating pressure of the hydraulic cylinder, such that the accumulator is active and variations occurring in the hydraulic pressure of the hydraulic cylinder during operation of the crusher system are attenuated.

7 Claims, 7 Drawing Sheets

=

+

+

ATTENUATION OF PRESSURE VARIATIONS IN CRUSHERS

This application claims priority under 35 U.S.C. §119 to Swedish Patent Application No. 0800760-1, filed on Apr. 4, 2008, which is incorporated by reference herein in its entirety.

FIELD OF THE INVENTION

The present invention relates to a crusher system including a first crushing surface and a second crushing surface, the two crushing surfaces being operative for crushing material between them. The crusher system includes a hydraulic system which is operative for adjusting a gap between the first crushing surface and the second crushing surface by adjusting the position of the first crushing surface by a hydraulic cylinder connected to the first crushing surface.

The present invention further relates to a method of crushing material between a first crushing surface and a second crushing surface.

BACKGROUND OF THE INVENTION

Crushers are utilized in many applications for crushing hard material, such as rocks, ore, etc. One type of crusher is the gyratory crusher, which has a crushing head which is forced to gyrate inside a fixed crushing shell. A crushing chamber, into which pieces of rock are to be fed, is formed between a crushing mantle, which is supported by the crushing head, and the crushing shell. The width of the crushing chamber, often referred to as the gap or the setting of the crusher, may be adjusted by a hydraulic arrangement. During the crushing of rock, ore etc. the crusher is subjected to large load variations. Such load variations cause wear, including metal fatigue, in the crusher, and may decrease the life of the crusher.

Patent document GB 1 517 963 discloses a gyratory crusher having a hydraulic cylinder or an air cylinder for preventing overload situations. A pressure buffer is operative for accommodating sudden heavy load changes in the hydraulic system. The pressure buffer is connected to the hydraulic system and by a point of constriction provided between the cylinder and the pressure buffer.

While the pressure buffer of GB 1 517 963 may be operative for reducing the negative effects of sudden heavy load changes, it is not effective for reducing the normal load variations that cause fatigue failure in the crusher.

SUMMARY OF THE INVENTION

An object of the present invention to provide a crusher system in which the risks of fatigue failure is reduced.

Another object of the present invention to provide a crusher system in which the load can be increased, without decreasing the lifetime of the crusher.

In an embodiment, the invention provides a crusher system, including a first crushing surface and a second crushing surface which are operative to crush material between them. A hydraulic system is operative to adjust a gap between the first crushing surface and the second crushing surface by adjusting a position of the first crushing surface with a hydraulic cylinder connected to the first crushing surface. The hydraulic system includes an accumulator connected to the hydraulic cylinder by a hydraulic liquid conduit. The accumulator includes a hydraulic liquid chamber and a gas chamber separated from the hydraulic liquid chamber. The accumulator has a preloading pressure that is the pressure of the gas chamber when the hydraulic liquid chamber is empty, which is at least 0.3 MPa lower than a mean operating pressure of the hydraulic cylinder, such that the accumulator is active and variations occurring in the hydraulic pressure of the hydraulic cylinder during operation of the crusher system are attenuated.

An advantage of this crusher system is that the fatigue stresses on the crusher system can be substantially reduced, because the accumulator, being in hydraulic contact with the hydraulic cylinder during normal operation of the crusher system, is operative for attenuating almost all load changes, such that the load on the crusher system, and in particular the pressure in the hydraulic system, will vary much less compared to prior art crusher systems.

The preloading pressure of the accumulator may be 0.3 to 1 MPa lower than the mean operating pressure of the hydraulic cylinder. Such a preloading pressure has been found to provide an efficient attenuation of the load on the crusher system, without negatively affecting the crushing of material in the crusher.

The natural oscillation frequency, $\omega_a$, of the accumulator may fulfil the condition:

$$\omega_a > 10*2\pi*f_r$$

wherein $f_r$ is the number of rounds per second of an eccentricity operative to make at least one of the first and second crushing surfaces gyrate. An advantage of this embodiment is that the response of the accumulator is very quick, such that it can respond to very quick load changes.

The distance L, as seen along the hydraulic liquid path, between the hydraulic cylinder and the accumulator, may fulfill the condition:

$$L <= v/(20*f_r)$$

wherein v is the velocity of sound in the hydraulic liquid, and $f_r$ is the number of rounds per second of an eccentricity operative to make at least one of the first and second crushing surfaces gyrate. An advantage of this embodiment is that the response of the accumulator to load changes is not delayed by a long time for these load changes to influence the accumulator.

The natural frequency, $\omega_n$, of a system comprising the accumulator and the mass carried by the hydraulic cylinder may fulfil the condition:

$$\omega_n > 4\pi*f_r$$

wherein $f_r$ is the number of rounds per second of an eccentricity operative to make at least one of the first and second crushing surfaces gyrate. An advantage of this embodiment is that resonance related problems in the attenuation of pressure variations is avoided.

The crusher system may include a control device, which is operative for controlling the preloading pressure of the accumulator in view of the actual mean operating pressure of the hydraulic cylinder. An advantage of this embodiment is that the preloading pressure can be varied to be suitable for the actual operating conditions of the crusher.

It is a still further object of the present invention to provide a method of crushing material, by which the fatigue stresses on the crusher can be reduced.

In another embodiment, the invention provides a method of crushing material, including providing a first crushing surface and a second crushing surface, operating a hydraulic system to adjust a gap between the first crushing surface and the second crushing surface by adjusting a position of the first crushing surface with a hydraulic cylinder connected to the first crushing surface, and attenuating variations occurring in the hydraulic pressure of the hydraulic cylinder by an accumulator being in contact, via a hydraulic liquid, with the hydraulic cylinder, the accumulator including a hydraulic liquid chamber and a gas chamber separated from the hydraulic liquid chamber, the accumulator having a preloading pressure, being the pressure of the gas chamber when the hydraulic liquid chamber is empty, which is at least 0.3 MPa lower than a mean operating pressure of the hydraulic cylinder.

An advantage of this method is that the load variations influencing the crusher are attenuated by the accumulator. Thanks to this, the lifetime of a crusher can be increased, and/or the crusher can be operated at a higher mean operating pressure.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
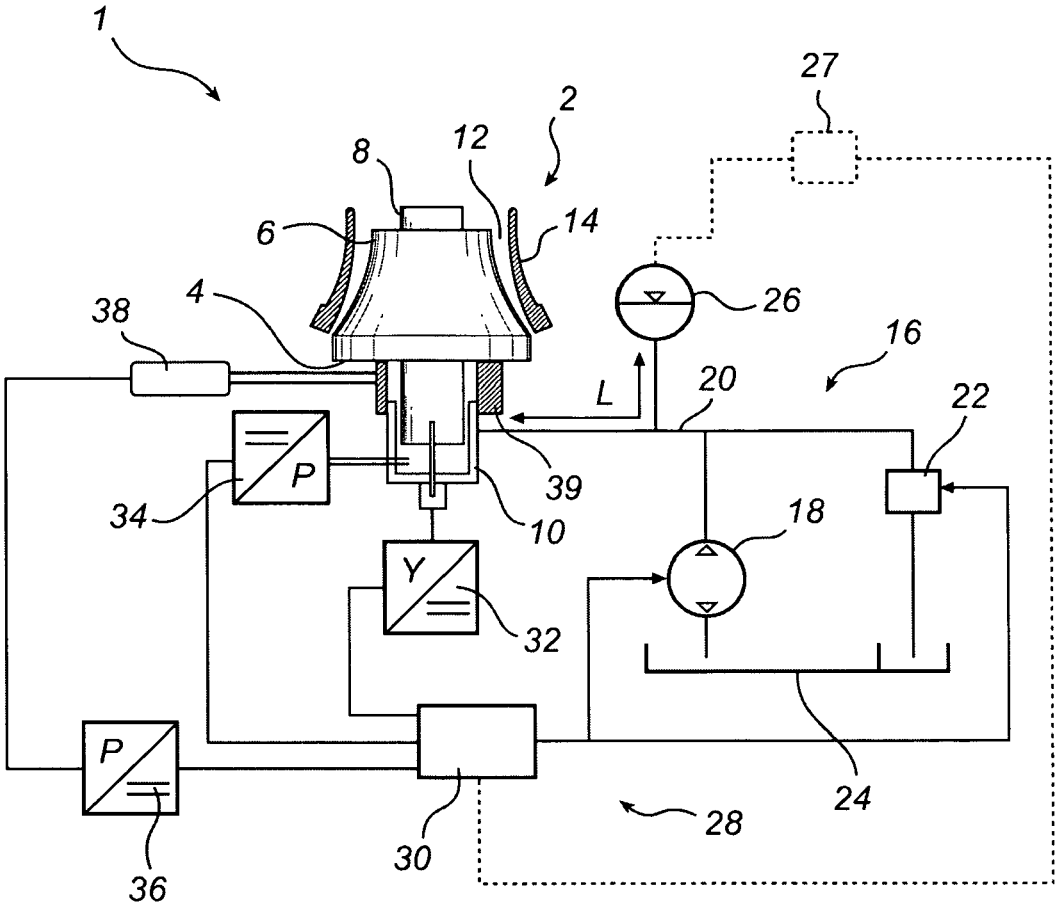
FIG. 1 is a schematic side view and illustrates a crusher system.

FIG. 1 illustrates a crusher system 1. The crusher system 1 includes a gyratory crusher 2, see for example GB 1 517 963. The gyratory crusher 2 includes a crushing head 4, which supports a first crushing surface formed on a crushing mantle 6 and which is fixed to a vertical shaft 8. The crushing head 4, being fixed to the vertical shaft 8, is movable in the vertical direction by a hydraulic cylinder 10 connected to the lower part of the shaft 8. The hydraulic cylinder 10 makes it possible to adjust the width of a gap 12 formed between the crushing mantle 6 and a second crushing surface formed on a stationary crushing shell 14, which surrounds the crushing mantle 6.

The crusher system 1 further includes a hydraulic system 16. The hydraulic system 16 includes a pump 18, which is operative for pumping hydraulic liquid to or from the hydraulic cylinder 10 via a pipe 20. A dump valve 22 is operative for rapidly dumping hydraulic liquid from the hydraulic cylinder 10, in particular in situations when the gyratory crusher 2 becomes overloaded. The dump valve 22 is operative for dumping the hydraulic liquid into a tank 24, which also serves as a pump sump for the pump 18. The hydraulic system 16 also includes an accumulator 26, which will be described in more detail hereinafter.

The crusher system 1 further includes a control system 28. The control system 28 includes a control device 30 which is operative for receiving various signals indicating the operation of the gyratory crusher 2. Thus, the control device 30 is operative for receiving a signal from a position sensor 32 which indicates the present vertical position of the vertical shaft 8. From this signal the width of the gap 12 can be calculated. Furthermore, the control device 30 is operative for receiving a signal from a pressure sensor 34, indicating the hydraulic pressure in the hydraulic cylinder 10. Based on the signal from the pressure sensor 34, the control device 30 can calculate the actual mean operating pressure and the peak pressure of the gyratory crusher 2. The control device 30 may also receive a signal from a power sensor 36, which is operative for measuring the power supplied to the gyratory crusher 2 from a motor 38, which is operative for making the vertical shaft 8 gyrate. The gyratory movement of the vertical shaft 8 is accomplished by the motor 38 driving an eccentricity 39, which is arranged around the vertical shaft 8, and which is schematically illustrated in FIG. 1. The power sensor 36 may also send a signal to the control device 30 indicating the number of rounds per second (in the unit 1/s or Hz), $f_r$, of the eccentricity 39.

The control device 30 is operative for controlling the operation of the pump 18, for example in an on/off manner, or in a proportional manner, such that the pump 18 supplies an amount of hydraulic liquid to the hydraulic cylinder 10 that generates a desired vertical position of the vertical shaft 8, and a desired width of the gap 12. The control device 30 is also operative for controlling the opening of the dump valve 22. High pressure peaks, such as peaks caused by tramp entering the gap 12, are handled by the control device 30 sending a signal to the dump valve 22 to the extent that immediate opening is required.

Thus, in the crusher system 1 long term variations in the hydraulic pressure, e.g., variations that occur over time spans of 1 second and more, are handled by the control device 30 controlling the pump 18. High, and sudden, pressure peaks, caused by, e.g., tramp, are handled by the control device 30 controlling the dump valve 22.

Figure 2A:
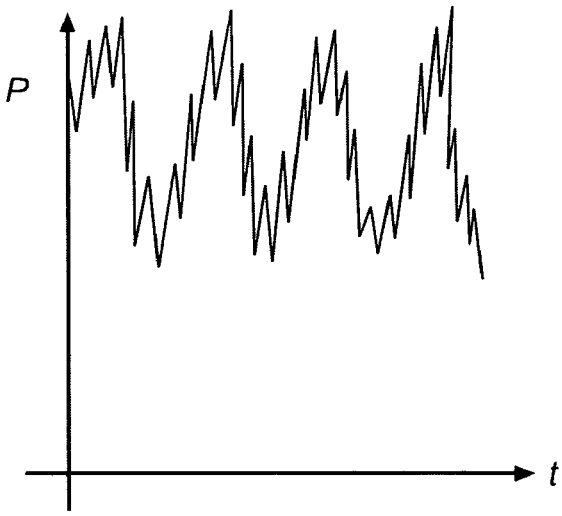
FIG. 2*a-d* are diagrams illustrating a hydraulic pressure, and the components thereof, in a prior art crusher.

FIG. 2*a* illustrates, schematically, the hydraulic liquid pressure measured by a pressure sensor, similar to the sensor 34, when operating a gyratory crusher, which is similar to the gyratory crusher 2, in accordance with the teachings of the prior art. The Y-axis of the diagram of FIG. 2*a* represents the pressure, P, in Pascals, and the X-axis of the diagram represents the time, in seconds. The total time span, which is illustrated in the diagram of FIG. 2*a*, is about 1 second. When analyzing the pressure curve of FIG. 2*a*, it has been found that it includes three components.

Figure 2B:
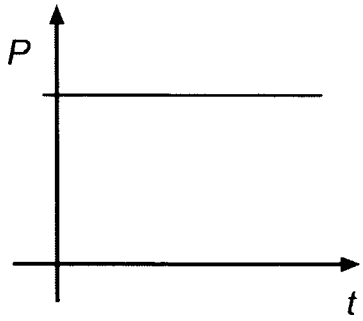

FIG. 2*b* illustrates a first component of the pressure, namely the mean operating pressure. A high mean operating pressure indicates an efficient operation of the gyratory crusher, meaning higher reduction ratios of rock size, and for that reason it is desired to keep the mean operating pressure as high as possible. Over the mean operating pressure other, unwanted, components are superimposed, as will be illustrated with reference to FIGS. 2*c* and 2*d*.

Figure 2C:
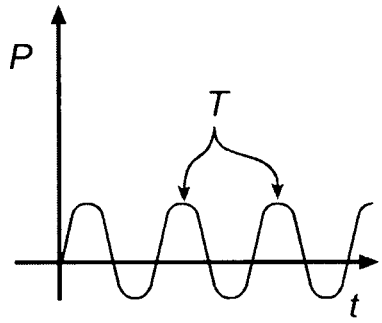

FIG. 2*c* illustrates a second component of the pressure, namely what can be called the synchronous or sinusoidal component. The sinusoidal component is caused by the gyratory movement of the vertical shaft, causing a sinusoidal component having the same frequency as the frequency of gyration of the vertical shaft. Hence, the period of the sinusoidal component corresponds to one turn of the eccentricity making the vertical shaft gyrate. The sinusoidal component is mainly caused by an uneven distribution of the material fed to the crusher, geometric eccentricity of the crushing mantle and/or the crushing shell, etc. If, for example, most of the material to be crushed is fed to one side of the gap, then the pressure will have a peak corresponding, in time, to occasions when the gap has, due to the gyratory movement of the vertical shaft, its most narrow width at the one side. The peaks of the sinusoidal component, indicated by a T in FIG. 2*c*, correspond to the highest pressure levels in the gyratory crusher, and result in the highest load on the gyratory crusher. A control device controlling the operation of a prior art gyratory crusher is operative for controlling a hydraulic pump, which is similar to the pump 18, to supply a hydraulic operating pressure which is as high as possible, without causing damage to the gyratory crusher. The peaks, T, of the sinusoidal component is normally what sets the upper limit for such a hydraulic operating pressure.

Figure 2D:
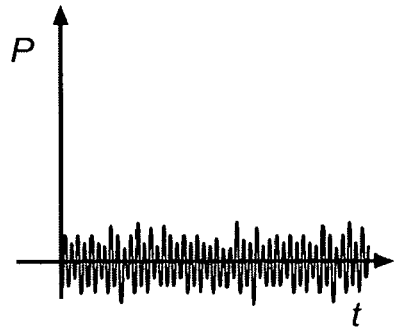
Fig. 2d (Prior art)

FIG. 2*d* illustrates a third component of the pressure, namely the high frequency component. This component is caused by the nature of the crushing process itself. As can be seen from FIG. 2*d*, the amplitude of the third component is rather small compared to the second component illustrated in FIG. 2*c*. However, since the three components are in reality added to each other, the third component also adds to the peaks of the sinusoidal component, thereby further increasing the pressure variation.

In an embodiment, the present invention concerns a crusher system 1 in which the pressure variations caused by the second component, i.e., the synchronous or sinusoidal component, and the third component, i.e., the high frequency component, are minimized, and in which the first component, i.e., the mean operating pressure, can be maximized, such that the gyratory crusher 2 operates in an efficient manner, without being exposed to large fatigue stresses.

In the crusher system 1, the accumulator 26 has a special design to be operative for filtering out small and rapid pressure changes, pressure changes that cannot be handled by either the pump 18 or the dump valve 22. This function of the accumulator 26 has been made possible by a design of the accumulator 26, which will be described hereinafter and which provides for improved crushing efficiency and an increased life of the gyratory crusher 2, due to the reduced pressure variations.

Figure 3:
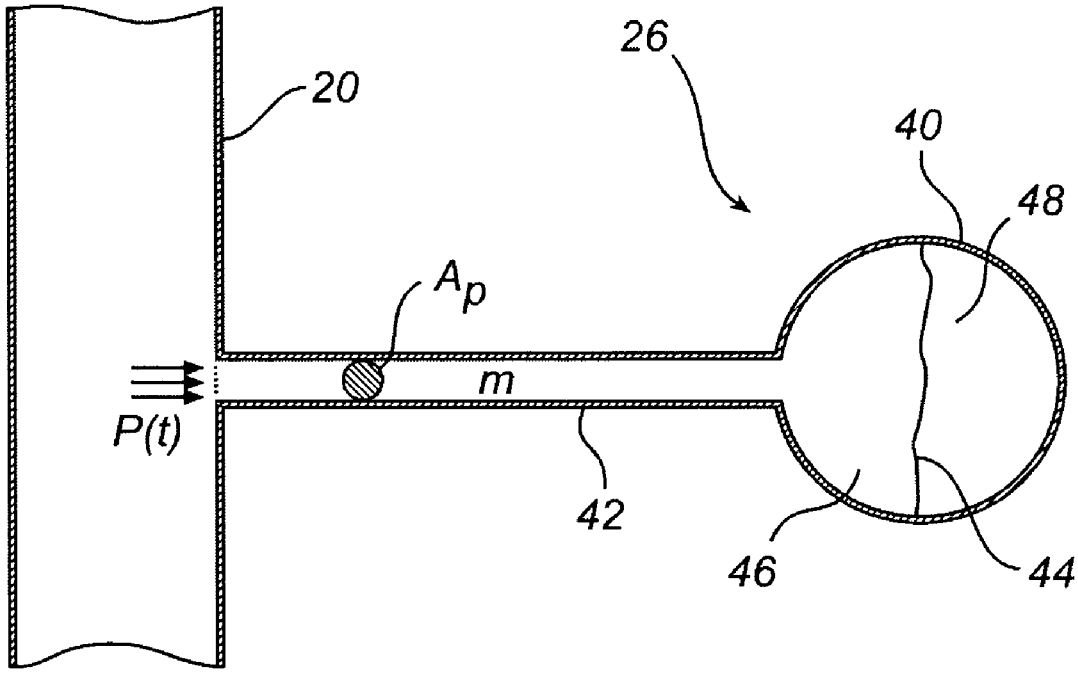
FIG. 3 is a schematic side view and illustrates an accumulator.

FIG. 3 illustrates the accumulator 26 in more detail. The accumulator 26 includes an accumulator body 40 which is connected to the pipe 20, which has been described hereinbefore with reference to FIG. 1, by a connecting pipe 42. The accumulator body 40 has a flexible inner membrane 44 which separates a hydraulic liquid compartment 46 from a pressurized gas compartment 48. The pipe 20 is connected to the hydraulic cylinder 10 illustrated hereinbefore with reference to FIG. 1. Thus, the pressure changes occurring in the hydraulic cylinder 10 as a result of the crushing of material in the gyratory crusher 2 will propagate through the pipe 20 and further through the connecting pipe 42 and will influence the hydraulic liquid compartment 46 of the accumulator body 40.

A first parameter in the design of the accumulator 26 is the preloading pressure. The pressurized gas compartment 48 is filled by a gas, which is often nitrogen gas, but which could also be air, or another suitable gas. The preloading pressure of the accumulator 26 is the pressure of the gas in the pressurized gas compartment 48 when the hydraulic liquid compartment 46 is completely empty. When the preloading pressure has been applied to the pressurized gas compartment 48 and the hydraulic liquid compartment 46 is at a lower pressure than the preloading pressure, the flexible inner membrane 44 will be forced, by the action of the pressurized gas, to the bottom of the accumulator body 40, i.e., towards the point were the connecting pipe 42 is connected to the accumulator body 40, and there will be basically no hydraulic liquid inside the accumulator body 40. Hence, when the pressure in the hydraulic system 16 is lower than the pre-loading pressure, the accumulator 26 is not operating.

The preloading pressure is set to such a value that the accumulator 26 is active during operation of the gyratory crusher 2. Thus, the preloading pressure is preferably at least 0.3 MPa lower than the lowest mean operating pressure of the gyratory crusher 2. In some cases, operation at the lowest mean operating pressure occurs only rarely. In such cases the preloading pressure could be set to be at least 0.3 MPa lower than the normal mean operating pressure of the gyratory crusher 2. Preferably, the preloading pressure should be 0.3-1.0 MPa lower than the lowest mean operating pressure, or 0.3-1.0 MPa lower than the normal mean operating pressure, as the case may be, of the gyratory crusher 2. Thus, if the gyratory crusher 2 would be operating at a mean operating pressure in the range of 3-5 MPa (absolute pressure), i.e., with a lowest mean operating pressure of 3 MPa (a), then the preloading pressure of the accumulator 26 should, for example, be maximum 2.7 MPa (a). If, on the other hand, operating at the lowest mean operating pressure of 3 MPa (a) is quite rare, and the crusher normally operates at a mean operating pressure of 4 MPa (a), then the preloading pressure of the accumulator 26 could be set to be maximum 3.7 MPa (a). As is clear from the above, the accumulator 26 will, due to the set preloading pressure, be active to attenuate the pressure variations that more or less continuously occur in the hydraulic cylinder 10 due to the normal crushing process. Since the preloading pressure of the accumulator 26 is at least 0.3 MPa lower than the mean operating pressure, there will, during normal operation of the gyratory crusher 2, always be some hydraulic fluid in the hydraulic liquid compartment 46 of the accumulator 26, such that both increases and decreases in the hydraulic pressure of the hydraulic cylinder 10 can be attenuated. As illustrated in, for example, FIG. 1 there is no valve or similar device arranged in the pipe 20 between the hydraulic cylinder 10 and the accumulator 26, which means that the accumulator 26 will be in continuous hydraulic fluid contact with the hydraulic cylinder 10 during normal crushing operation of the crusher system 1 and will be active to attenuate the normal pressure variations occurring in the hydraulic cylinder 10.

In accordance with an alternative embodiment, also illustrated with reference to FIG. 1, the preloading pressure of the accumulator 26 could be variable. In FIG. 1, a supply 27 of pressurized nitrogen gas is schematically illustrated with dotted lines. The control device 30 could be operative to control the supply 27 of pressurized nitrogen gas to supply a suitable nitrogen pressure to the pressurized gas compartment 48 of the accumulator 26. Hence, the control device 30 could be operative for controlling the preloading pressure of the accumulator 26, such that the preloading pressure is always below the actual mean operating pressure at that specific occasion. For example, if the control device 30 calculates, based on information from the pressure sensor 34, that the mean operating pressure is 4 MPa (a), then it could order the supply 27 of pressurized nitrogen gas to supply a preloading pressure of 3.5 MPa (a) to the accumulator 26. At another occasion the control device 30 calculates the mean operating pressure to be 3.7 MPa (a), and then orders the supply 27 of pressurized nitrogen gas to supply a preloading pressure of 3.2 MPa (a) to the accumulator 26. Hence, irrespective of the actual mean operating pressure, the control device 30 would, in accordance with this option, ensure that the preloading pressure of the accumulator 26 is always lower than the mean operating pressure, and is suitable for the mean operating pressure in question. It will be appreciated that changes in the preloading pressure would normally be made before starting operation of the crusher 2. However, changes in the preloading pressure could also be performed during operation of the gyratory crusher 2, in which case the control device 30 would have to account for the fact that the hydraulic liquid is at a higher than atmospheric pressure when determining the gas pressure to be supplied to the pressurized gas compartment 48 of the accumulator 26. A further option includes a shut-off in the connecting pipe 42, such that the accumulator 26 could be taken off line temporarily when the pressure in the hydraulic system 16 is "too low," meaning that the pressure in the hydraulic system 16 is almost equal to, or lower than, the preloading pressure of the accumulator 26, to avoid that the flexible inner membrane 44 of the accumulator 26 from hitting the bottom of the accumulator body 40, causing a risk of damage to the membrane 44.

Figure 4A:
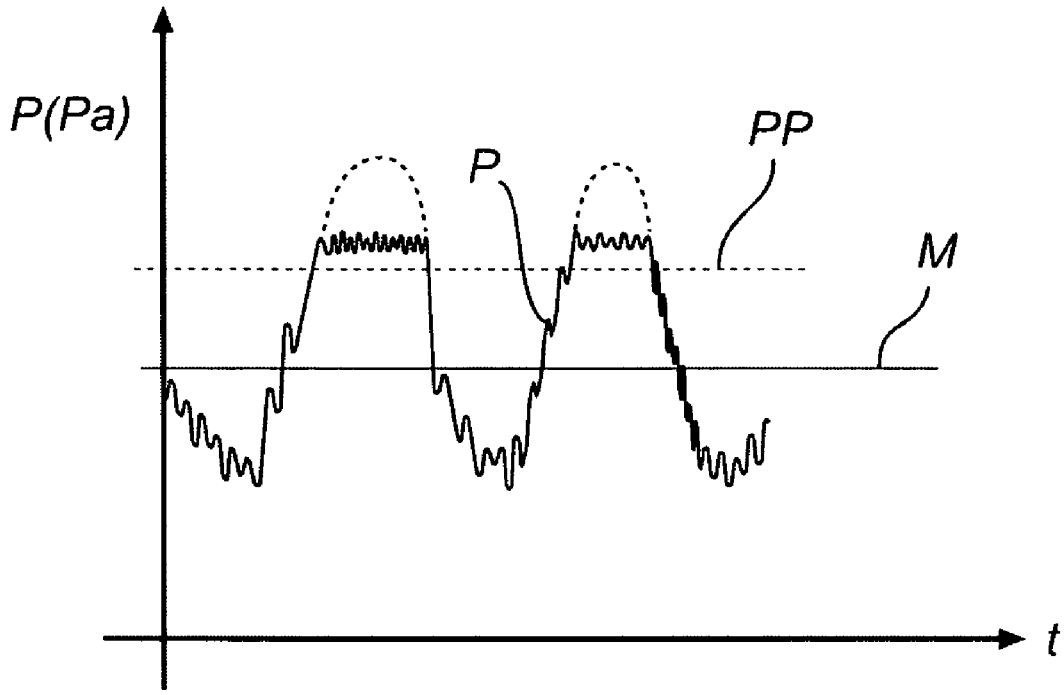
FIG. 4*a* is a diagram and illustrates a pressure curve obtained when operating an accumulator with a high preloading pressure.

FIG. 4*a* illustrates the hydraulic liquid pressure curve P resulting from operation with an accumulator having a preloading pressure PP which is higher than the actual mean operating pressure M of the crusher. As compared to the pressure curve illustrated in FIG. 2*a*, the highest peaks are cut by the accumulator, but the pressure still varies considerably.

Figure 4B:
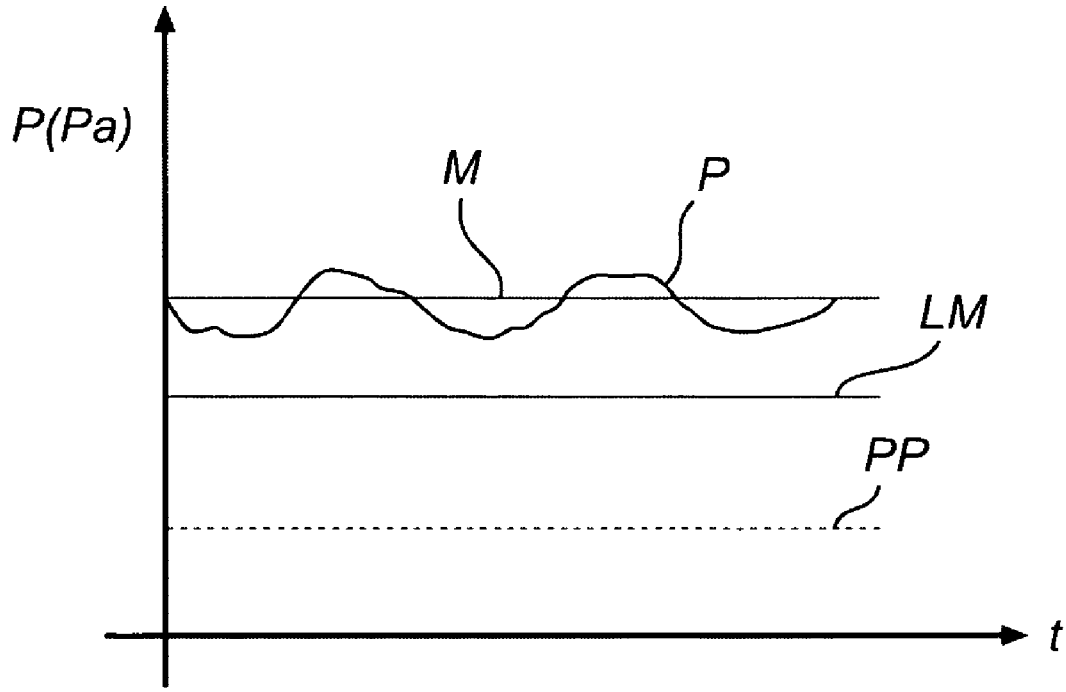
FIG. 4*b* is a diagram and illustrates a pressure curve obtained when operating an accumulator with a suitable preloading pressure.

FIG. 4*b* illustrates the hydraulic liquid pressure curve P resulting from operation with the accumulator 26, illustrated in FIG. 1, having a preloading pressure PP that is about 0.5 MPa lower than the lowest mean operating pressure LM, in accordance with the principles of preferred preloading pressures, as described hereinbefore. At the occasion illustrated in FIG. 4*b* the actual mean operating pressure M is higher than the lowest mean operating pressure LM. As can be seen from FIG. 4*b*, the accumulator 26 results in very smooth appearance of the hydraulic liquid pressure curve P. Such smooth pressure behavior decreases the fatigue stresses on the gyratory crusher 2, and also makes it possible to operate at a higher mean operating pressure, without exceeding the maximum pressure limits.

To obtain a suitable operation of the accumulator 26, it is also preferable that the accumulator 26 has a very quick response to pressure variations. This means that variations in the volume of hydraulic liquid in the accumulator 26 should occur as soon as possible after a pressure variation has occurred in the hydraulic cylinder 10, which has been described hereinbefore with reference to FIG. 1. The natural oscillation frequency of the accumulator 26 depends on the mass of hydraulic liquid inside the accumulator body 40 and in the connecting pipe 42, both of which have been illustrated hereinbefore with reference to FIG. 3, and the spring constant of the accumulator 26 at the working point. The natural oscillation frequency of the accumulator 26 should be substantially higher than the frequency of rotation of the eccentricity 39, illustrated hereinbefore with reference to FIG. 1. The natural oscillation frequency of the accumulator 26 can be calculated based on the following equation:

$$\omega_a = \sqrt{\frac{\Delta P}{\Delta V}\frac{A_p^2}{m}} \qquad \text{[eq. 1.1]}$$

The following parameters are included in this equation:

$\omega_a$=natural oscillation frequency of accumulator 26 including connecting pipe 42, unit: [rad/s]

Ap=section area of the connecting pipe 42, see FIG. 3, unit: [$m^2$]

m=mass of hydraulic liquid in connecting pipe 42 including the hydraulic liquid in the liquid compartment 46, unit: [kg]

$\Delta P/\Delta V$=the rate of variation of pressure with respect to the variation of gas volume in the accumulator at a certain mean pressure, unit: [$Pa/m^3$]

Figure 5A:
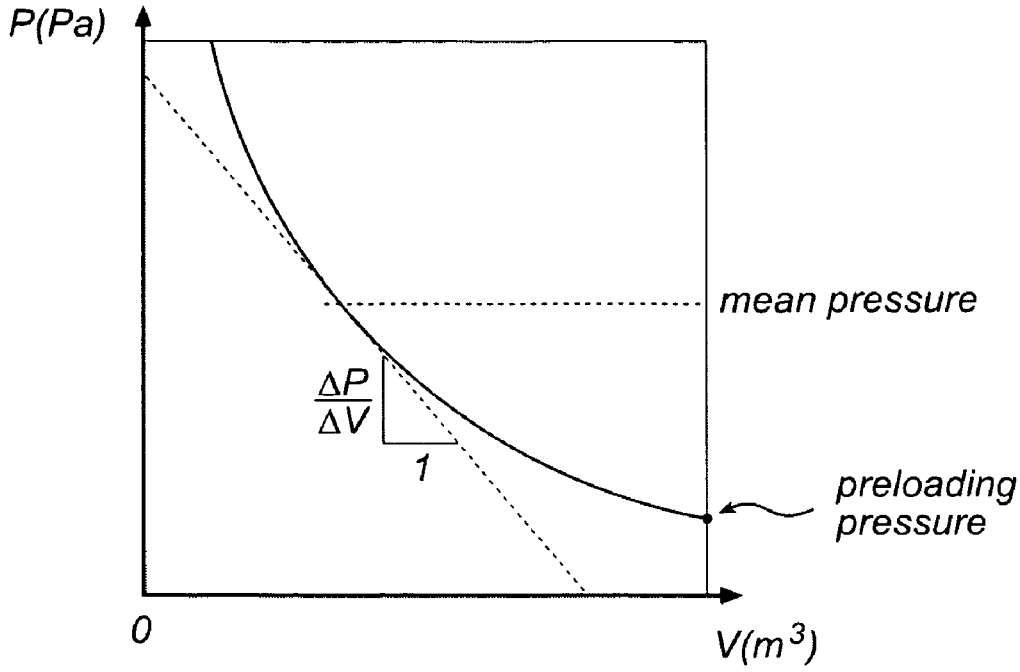
FIG. 5*a* is a diagram and illustrates the relation between the volume and pressure of the gas of an accumulator.

FIG. 5*a* illustrates the relation between the volume of gas in the gas compartment 48 of the accumulator 26, and the pressure of the gas in the gas compartment 48. Hence, the x-axis is the volume of gas in $m^3$, and the y-axis is the pressure in Pa. The solid curve illustrates the relation between the pressure and the volume of the gas in the gas compartment 48. The preloading pressure has been marked at the right of the curve. At the preloading pressure the volume of gas in the gas compartment 48 is maximal. The expression $\Delta P/\Delta V$ of eq. 1.1 above is calculated as the derivative of the volume/pressure curve of FIG. 5*a* at the mean pressure. This derivative is illustrated as a straight dotted line in FIG. 5*a*. Hence, the expression $\Delta P/\Delta V$ is to some extent dependent on the mean operating pressure. When calculating $\omega_a$ in accordance with eq. 1.1, it is normally best to calculate $\Delta P/\Delta V$ at a mean operating pressure which lays between the maximum and minimum mean operating pressures at which the crusher will normally operate. Hence, if the crusher may operate at mean operating pressures of 3-5 MPa, the $\Delta P/\Delta V$ is preferably calculated at a mean operating pressure of 4 MPa.

The natural oscillation frequency of the accumulator 26 is designed to fulfil the following condition:

$$\omega_a > 10 * 2\pi * f_r \qquad \text{[eq. 1.2]}$$

The following parameters are included in this equation:

$\omega_a$=natural oscillation frequency of accumulator 26 including connecting pipe 42, unit: [rad/s]

$f_r$=number of rounds per second of eccentricity 39, see FIG. 1, unit: [Hz].

Hence, the natural oscillation frequency $\omega_a$ in rad/s of the accumulator 26 is designed to be at least 10 times higher than the frequency of rotation (calculated as the number of rounds per second multiplied by $2\pi$ in rad/s, of the eccentricity 39, i.e., to be at least 10 times higher than the frequency of gyration of the vertical shaft 8 in rad/s. In the gyratory crusher 2, the number of rounds per second of the eccentricity 39 would typically be 3-7 rounds per second.

Figure 5B:
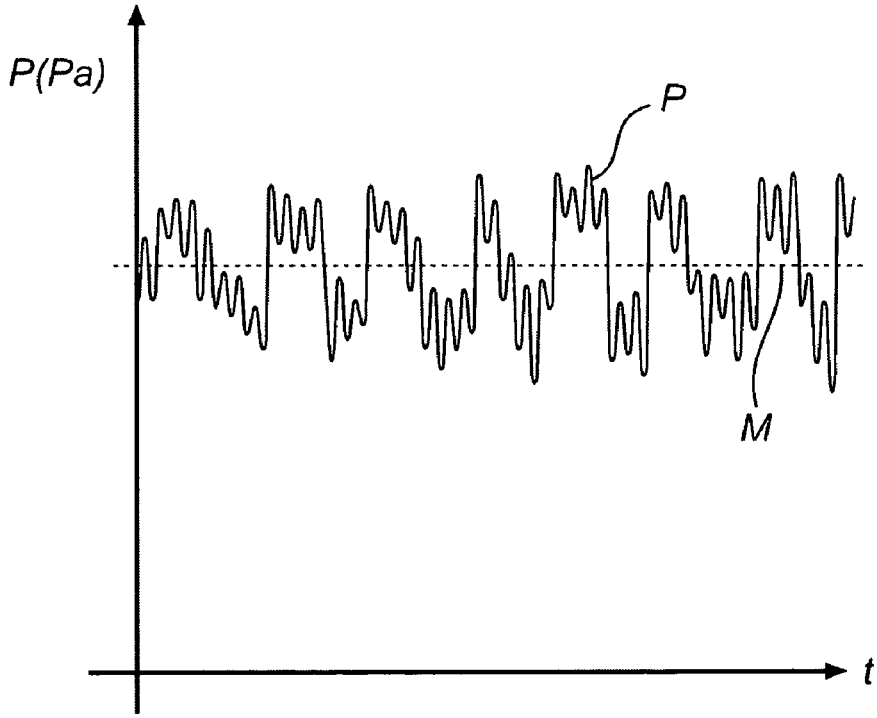
FIG. 5*b* is a diagram and illustrates a situation in which the natural oscillation frequency of the accumulator is too low.

FIG. 5*b* illustrates a situation in which the natural oscillation frequency $\omega_a$ of the accumulator 26 is too low, i.e., considerably lower than 10 times the frequency of rotation of the eccentric 39, in rad/s. As can be seen from FIG. 5*b*, the actual operating pressure P swings considerably around the mean operating pressure M.

Figure 5C:
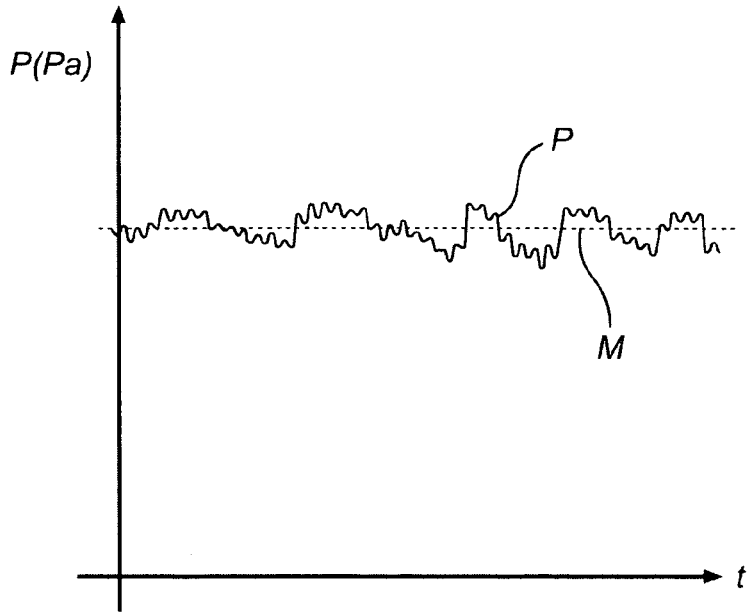
FIG. 5*c* is a diagram and illustrates a situation in which the natural oscillation frequency of the accumulator is suitable.

FIG. 5*c* illustrates a situation in which the natural oscillation frequency $\omega_a$ of the accumulator 26 fulfils the requirement of eq. 1.2. As can be seen from a comparison with FIG. 5*b*, there is in FIG. 5*c* almost no trace of the sinusoidal shape that is rather marked in FIG. 5*b*. Thus, the operating pressure P is, in FIG. 5*c*, all the time rather close to the mean operating pressure M.

A further condition for obtaining a short response time of the accumulator 26 is that the accumulator 26 should be arranged close to the hydraulic cylinder 10. The following condition should be fulfilled:

$$L<=v/(20*f_r) \quad \text{[eq. 2.1]}$$

The following parameters are included in this equation:

v=velocity of sound in hydraulic liquid, unit: [m/s].

$f_r$=number of rounds per second of the eccentricity, see FIG. 1, unit: [Hz].

L=distance, as seen along the hydraulic liquid path, between the hydraulic cylinder 10, and the accumulator 26, both of which have been described with reference to FIG. 1, unit: [m].

The distance L is also illustrated schematically in FIG. 1. As a pressure wave generated in the hydraulic cylinder 10 has a finite velocity it will take some time for the accumulator 26 to respond to a pressure variation occurring in the hydraulic cylinder 10, thereby causing a response delay. The equation 2.1 specifies a design which provides for a small response delay, and, thus, a quick reaction of the accumulator 26 to pressure variations occurring in the hydraulic cylinder 10.

Figure 6:
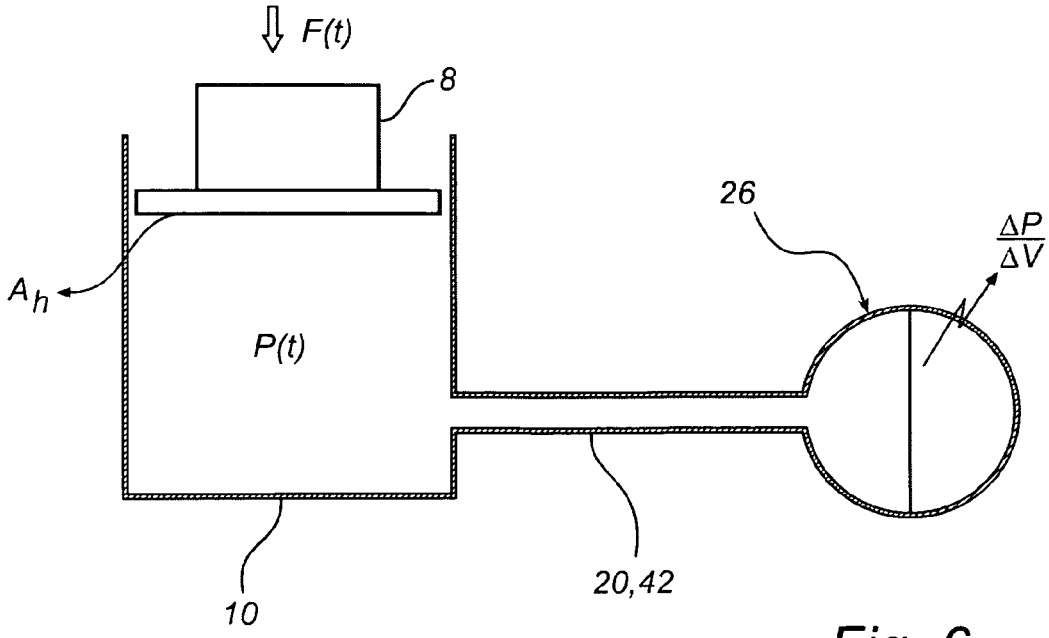
FIG. 6 is a schematic side view and illustrates a system formed by the interaction between an accumulator and the weight carried by a hydraulic cylinder.

FIG. 6 illustrates, schematically, a system formed by the accumulator 26 and the vertical shaft 8 of the gyratory crusher 2, the vertical shaft 8 including, in this regard, the weight of the crushing head 4 and the crushing mantle 6. As illustrated, the accumulator 26 is in continuous hydraulic fluid contact with the hydraulic cylinder 10 during normal crushing operation in the crusher system and will be active to attenuate the normal pressure variations occurring in the hydraulic cylinder 10. The crusher system 1 of FIG. 1 should be designed to avoid oscillation of the system formed by the interaction between the accumulator 26 and the vertical shaft 8. As illustrated in FIG. 6, a force F is generated by the crushing of material in the gyratory crusher. This force acts on the vertical shaft 8, which in turn co-operates with the hydraulic cylinder 10. The force F has a sinusoidal component at the frequency of rotation of the eccentricity 39, as illustrated hereinbefore in FIG. 2*c*. If the natural frequency of the system formed by the vertical shaft 8, the crushing head 4, the crushing mantle 6, the hydraulic cylinder 10, the accumulator 26, and the pipes 20, 42, is too low, and close to the frequency of rotation of the eccentricity 39, i.e., too close to the frequency of gyration of the vertical shaft 8, then there is a risk of resonance of the system, resulting in big oscillations. The natural frequency of the system can be calculated in the following way:

$$\omega_n = \sqrt{\frac{\Delta P}{\Delta V}\frac{A_h^2}{M}} \quad \text{[eq. 3.1]}$$

The following parameters are included in this equation:

$\omega_n$=natural frequency of the system including the vertical shaft 8, the crushing head 4, the crushing mantle 6, and the accumulator 26, unit: [rad/s].

$A_h$=section area of the piston of the hydraulic cylinder 10, see FIG. 6, unit: [$m^2$].

M=total mass of vertical shaft 8, crushing head 4, and crushing mantle 6, unit [kg].

$\Delta P/\Delta V$=pressure-volume variation due to accumulator 26, as explained hereinbefore with reference to FIG. 5*a*, unit: [$Pa/m^3$].

The natural oscillation frequency of the system including the vertical shaft 8, the crushing head 4, the crushing mantle 6, and the accumulator 26 is designed to fulfil the following condition:

$$\omega_n>4\pi f_r \quad \text{[eq. 3.2]}$$

The following parameters are included in this equation:

$\omega_n$=natural frequency of the system including the vertical shaft 8, the crushing head 4, the crushing mantle 6, and the accumulator 26, unit [rad/s].

$f_r$=number of rounds per second of the eccentricity 39, see FIG. 1, unit: [Hz].

Hence, the natural frequency $\omega_n$ of the system including the vertical shaft 8, the crushing head 4, the crushing mantle 6, and the accumulator 26 is designed to be about 2 times higher than the frequency of rotation (calculated as the number of rounds per second multiplied by $2\pi$ of the eccentricity 39, in rad/s, i.e., to be about 2 times higher than the frequency of gyration of the vertical shaft 8, in rad/s.

Figure 7A:
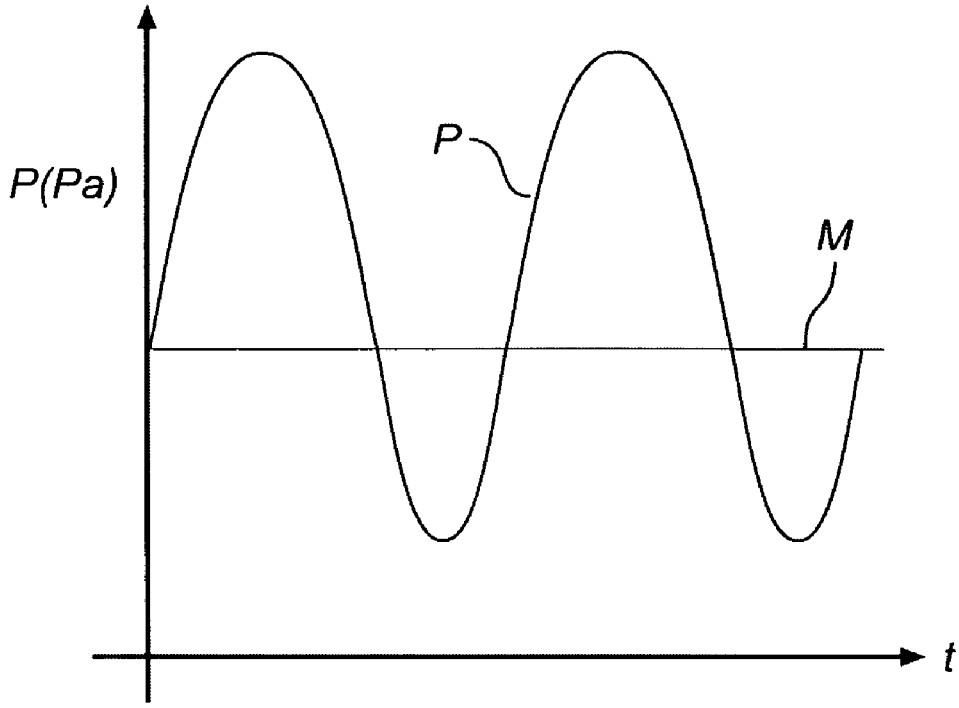
FIG. 7*a* is a diagram and illustrates a situation in which a natural frequency of a system comprising the weight and the accumulator is too low.

FIG. 7*a* illustrates a situation in which the natural frequency $\omega_n$ of the system including the vertical shaft 8, the crushing head 4, the crushing mantle 6, and the accumulator 26 is too low, i.e., considerably lower than 2 times the frequency of rotation of the eccentricity 39, in rad/s. As can be seen from FIG. 7*a*, the actual operating pressure P swings considerably around the mean operating pressure M. When comparing FIG. 7*a* and FIG. 2*a* it can be seen that, in fact, the operating pressure swings more with such a designed accumulator illustrated with reference to FIG. 7*a*, due a resonance phenomenon, than the case in which no accumulator at all is used, as illustrated in FIG. 2*a*.

Figure 7B:
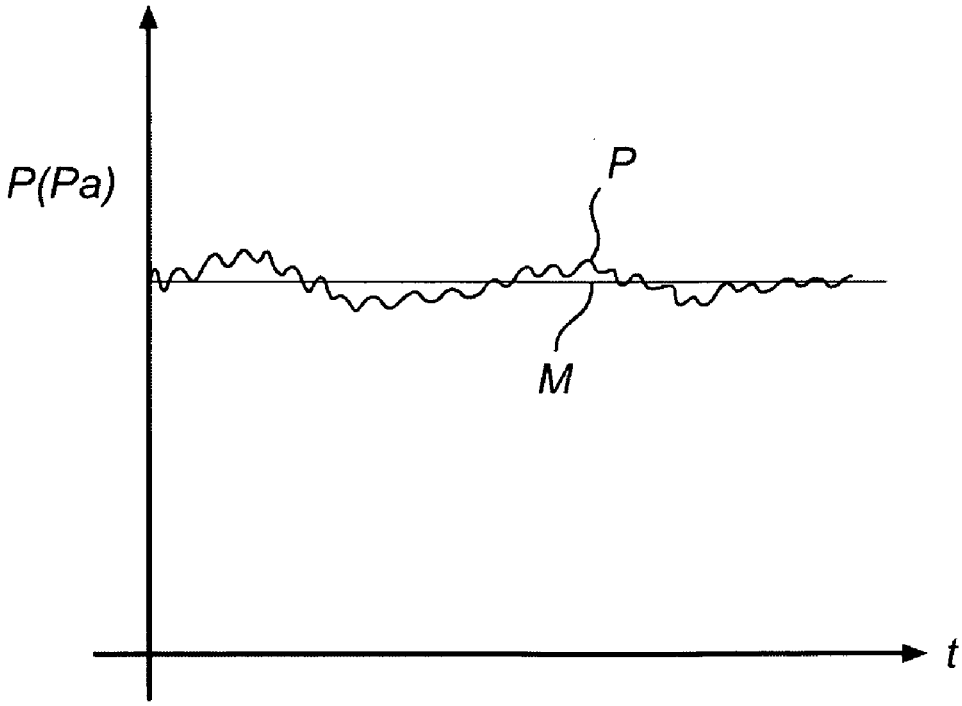
FIG. 7*b* is a diagram and illustrates a situation in which a natural frequency of a system comprising the weight and the accumulator is suitable.

FIG. 7*b* illustrates a situation in which the natural oscillation frequency $\omega_n$ of the system including the vertical shaft 8, the crushing head 4, the crushing mantle 6, and the accumulator 26 fulfils the requirement of eq. 3.2. As can be seen from a comparison with FIG. 7*a*, there is in FIG. 7*b* no resonance at all, and the sinusoidal component illustrated hereinbefore with reference to FIG. 2*c*, has been almost completely dampened. Thus, the operating pressure P is all the time rather close to the mean operating pressure M.

With a proper design of the accumulator 26, in accordance with the conditions described hereinbefore, it will work as a spring that attenuates pressure variations. When uneven feeding of material, segregation of material into small and large fractions on the feed conveyor belt, and geometric eccentricity of the crushing mantle 6 and/or the crushing shell 14 occurs, the pressure in the hydraulic cylinder 10 tends to fluctuate, as described hereinbefore with reference to FIG. 2*a* to 2*d*. Pressure peaks in the hydraulic cylinder 10 are attenuated by hydraulic liquid flowing from the hydraulic cylinder 10 to the accumulator 26. Pressure drops in the hydraulic cylinder 10 are attenuated by hydraulic liquid flowing from the accumulator 26 to the hydraulic cylinder 10. Hence, the pressure in the hydraulic cylinder 10 is kept more even, compared to the prior art.

The volume of the accumulator 26 depends on the volume of hydraulic liquid that will enter, or leave, the accumulator 26 when the accumulator 26 attenuates pressure variations. Thus, the volume of the accumulator 26 will depend on the size of the crusher, and the expected magnitude of the pressure variations that are to be attenuated.

The accumulator 26 results, as described hereinbefore, in a more even pressure in the hydraulic cylinder 10, which results in an increased crusher life, due to decreased fatigue stresses on the gyratory crusher 2. It is also possible, as alternative to increased life, or in combination therewith, to operate the gyratory crusher 2 at a higher mean operating pressure, resulting in an increased crushing efficiency of the gyratory crusher 2.

The heavy and sudden pressure changes are handled by the dump valve 22, as mentioned hereinbefore. As an alternative to the control device 30 controlling the dump valve 22, the dump valve 22 could be an automatic valve that opens automatically at a certain pressure.

In situations where the feed of material to the gyratory crusher 2 is suddenly stopped the pressure in the hydraulic cylinder 10 drops rapidly. In such a situation the accumulator 26 will forward hydraulic liquid to the hydraulic cylinder 10, which may make the vertical shaft 8 move vertically upwards. Such a vertical movement is not desired, since it may cause contact between the crushing mantle 6 and the crushing shell 14. The control device 30 would then, preferably, be designed to, in addition to the above mentioned function of opening the dump valve 22 in situations when the pressure in the hydraulic liquid is over a preset pressure, opening the dump valve 22 when the width of the gap 12 is under a preset limit, such that the hydraulic liquid from the accumulator 26 is dumped to the tank 24, instead of being forwarded to the hydraulic cylinder 10, in such situations when the vertical shaft 8 tends to move upwards.

While the invention has been disclosed with reference to certain preferred embodiments, numerous modifications, alterations, and changes to the described embodiments are possible without departing from the sphere and scope of the invention, as defined in the appended claims and their equivalents thereof. Above the attenuation of pressure variations in a gyratory crusher has been described. It will be appreciated that the present invention can be utilized also for other types of crushers in which at least one crushing surface is connected to a hydraulic cylinder, the pressure variations of which needs to be attenuated. The present invention can also be applied to crushers in which two, or more, crushing surfaces are connected to separate hydraulic cylinders. Hereinbefore it has been described that the accumulator 26 is in continuous hydraulic fluid contact with the hydraulic cylinder 10 to be active for attenuating pressure variations occurring during normal crushing operation. As has been disclosed, see for example FIG. 1 and FIG. 6, the accumulator 26 is directly coupled to the hydraulic cylinder 10, and there is no valve arranged in the pipe 20 between the hydraulic cylinder 10 and the accumulator 26. It will be appreciated that a shut-off valve could be arranged in this pipe 20, or more preferably in the connecting pipe 42, for the purpose of isolating the accumulator 26 from the hydraulic system 16 when service or repair needs to be done to the accumulator 26. It will be appreciated, furthermore, that when such a shut-off valve is shut, there is no attenuating function of the accumulator 26, meaning that periods of having such a shut-off valve shut should be kept as short as possible. Accordingly, it is intended that the invention not be limited to the described embodiments, but that it have the full scope defined by the language of the following claims.

What is claimed is:

1. A crusher system, comprising:

a first crushing surface and a second crushing surface which are operative to crush material between them;

a hydraulic system which is operative to adjust a gap between the first crushing surface and the second crushing surface by adjusting a position of the first crushing surface with a hydraulic cylinder connected to the first crushing surface;

the hydraulic system including a dump valve configured to dump hydraulic fluid from the hydraulic cylinder when the crusher system becomes overloaded;

the hydraulic system including an accumulator connected to the hydraulic cylinder by a hydraulic liquid conduit;

the accumulator including a hydraulic liquid chamber and a gas chamber separated from the hydraulic liquid chamber, the accumulator having a preloading pressure that is the pressure of the gas chamber when the hydraulic liquid chamber is empty, which is at least 0.3 MPa lower than a mean operating pressure of the hydraulic cylinder, such that the accumulator is active and synchronous variations occurring in the hydraulic pressure of the hydraulic cylinder during normal operation of the crusher system are attenuated by the accumulator.

2. The crusher system according to claim 1, wherein the preloading pressure of the accumulator is 0.3 to 1 MPa lower than the mean operating pressure of the hydraulic cylinder.

3. The crusher system according to claim 1, wherein the natural oscillation frequency, $\omega_a$, of the accumulator fulfils the condition:

$$\omega_a > 10*2\pi*f_r$$

wherein $f_r$ is the number of rounds per second of an eccentricity operative to make at least one of the first and second crushing surfaces gyrate.

4. The crusher system according to claim 1, wherein a distance L along a hydraulic liquid path between the hydraulic cylinder and the accumulator, fulfils the condition:

$$L <= v/(20*f_r)$$

wherein v is the velocity of sound in the hydraulic liquid, and $f_r$ is the number of rounds per second of an eccentricity operative to make at least one of the first and second crushing surfaces gyrate.

5. The crusher system according to claim 1, wherein the natural frequency, $\omega_n$, of a system including the accumulator and the mass carried by the hydraulic cylinder fulfils the condition:

$$\omega_n > 4\pi*f_r$$

wherein $f_r$ is the number of rounds per second of an eccentricity operative to make at least one of the first and second crushing surfaces gyrate.

6. The crusher system according to claim 1, further comprising a control device which is operative to control the preloading pressure of the accumulator in view of an actual mean operating pressure of the hydraulic cylinder.

7. The crusher system according to claim 1, wherein the crusher system comprises a gyratory crusher, the hydraulic cylinder being operative to adjust a vertical position of a crushing head that supports the first crushing surface.

* * * * *